United States Patent [19]

Visnic et al.

[11] Patent Number: 4,967,507

[45] Date of Patent: Nov. 6, 1990

[54] WINDOW FRAME

[75] Inventors: Ralph C. Visnic, Fullerton; Martin D. Givot, Villa Park, both of Calif.

[73] Assignee: Charles Visnic Aluminum, Inc., Riverside, Calif.

[21] Appl. No.: 352,372

[22] Filed: May 12, 1989

Related U.S. Application Data

[63] Continuation-in-part of Ser. No. 220,538, Jul. 18, 1985, abandoned.

[51] Int. Cl.[5] ..... E06B 1/04

[52] U.S. Cl. ..... 49/504; 49/408; 52/209; 52/309.4

[58] Field of Search ..... 49/504, 404, 408, 380; 52/204, 209, 207, 309.4

[56] References Cited

U.S. PATENT DOCUMENTS

| | | | |
|---|---|---|---|
| 2,787,034 | 4/1957 | Hauck | 52/209 |
| 3,106,754 | 10/1963 | Grossman | 49/408 |
| 3,861,444 | 1/1975 | Portwood | 49/504 X |
| 3,975,881 | 8/1976 | Ninowski, Jr. | 49/504 X |
| 4,299,060 | 11/1981 | Tippmann | 49/504 X |
| 4,503,641 | 3/1985 | Swan | 49/404 X |
| 4,516,356 | 5/1985 | Delman | 49/404 X |
| 4,715,152 | 12/1987 | Tanikawa | 49/408 X |

FOREIGN PATENT DOCUMENTS

| | | | |
|---|---|---|---|
| 572221 | 3/1959 | Canada | 49/380 |

*Primary Examiner*—Philip C. Kannan

*Attorney, Agent, or Firm*—Harvey C. Nienow

[57] ABSTRACT

A window frame wherein all of the frame members are formed with the same identical cross-sectional configuration as, for instance, in an aluminum extrusion. A spacer is slidably inserted into the frame member which is to be the lower-most frame member when the window frame is installed to allow for insertion of a windowpane. Each frame member includes means whereby the frame can be secured to the appropriate structural members of a building.

5 Claims, 3 Drawing Sheets

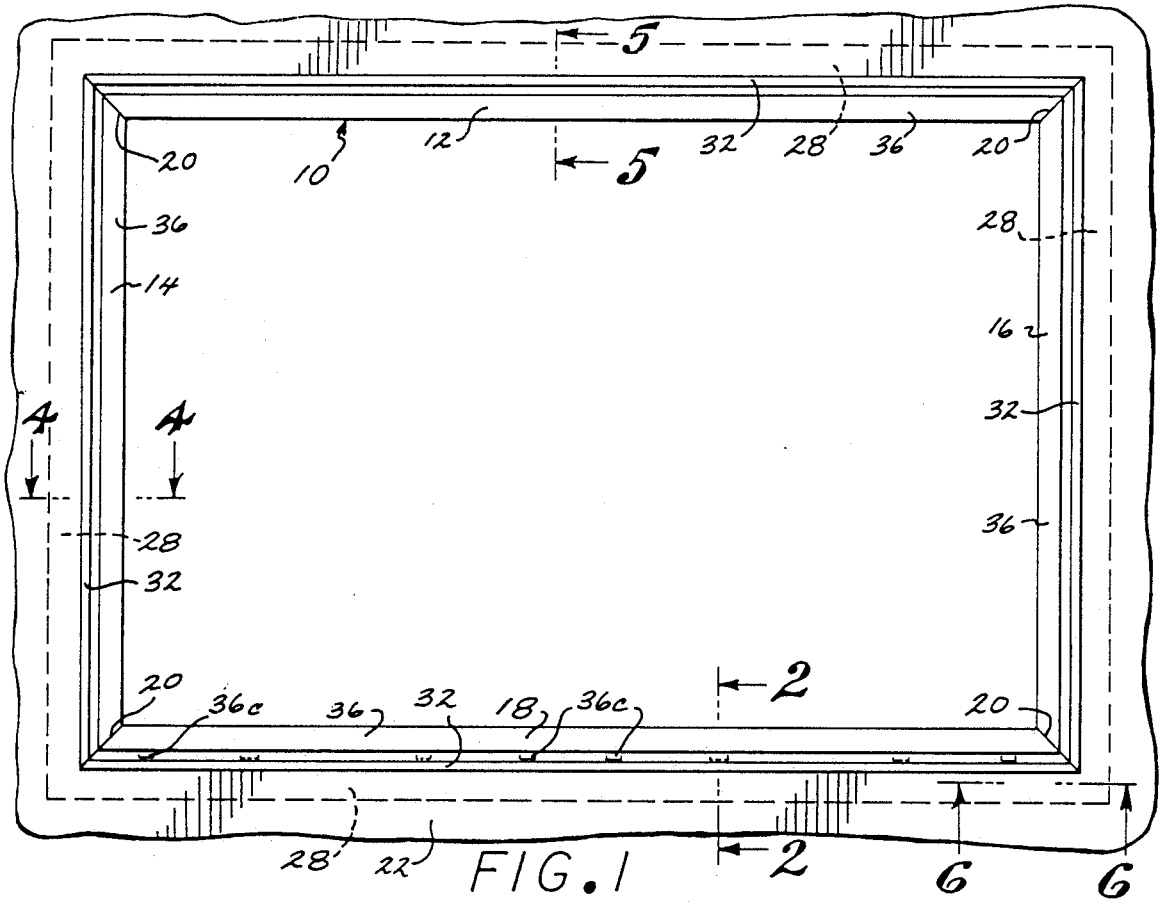
FIG. 1
FIG. 2
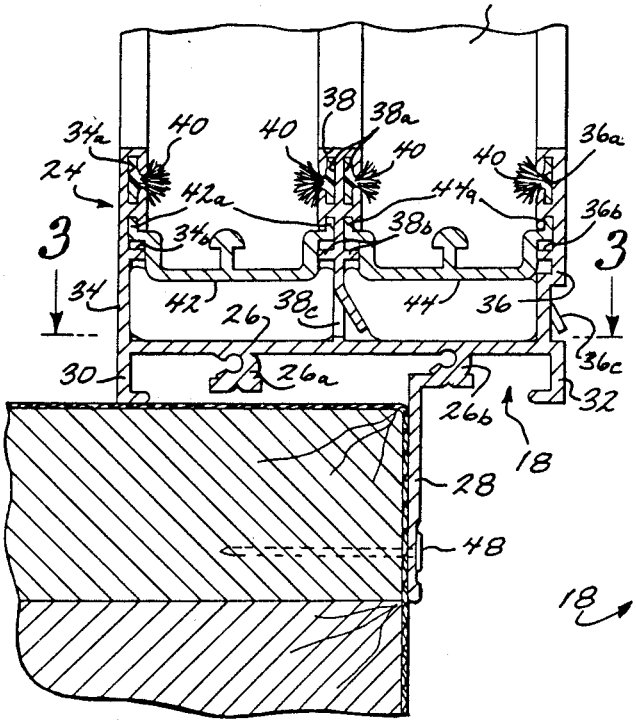
FIG. 3
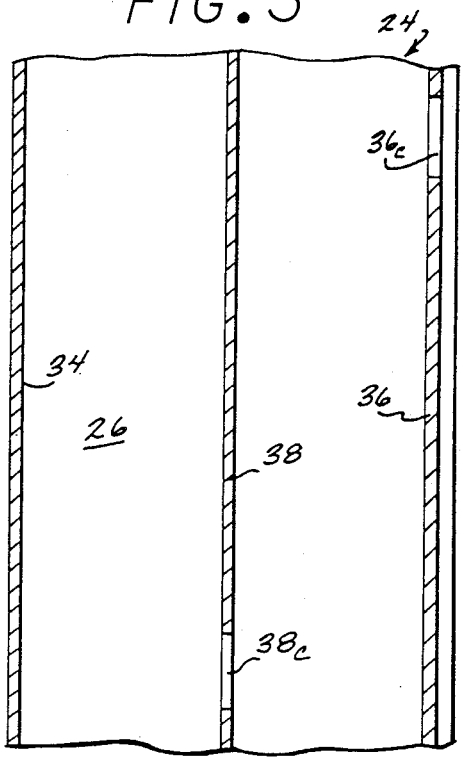

FIG. 4
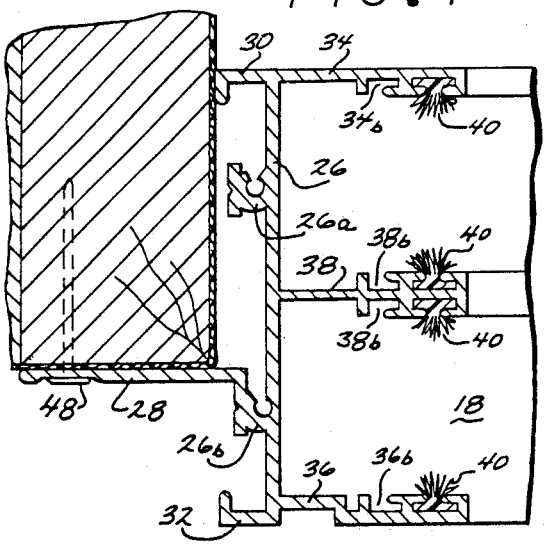
FIG. 5
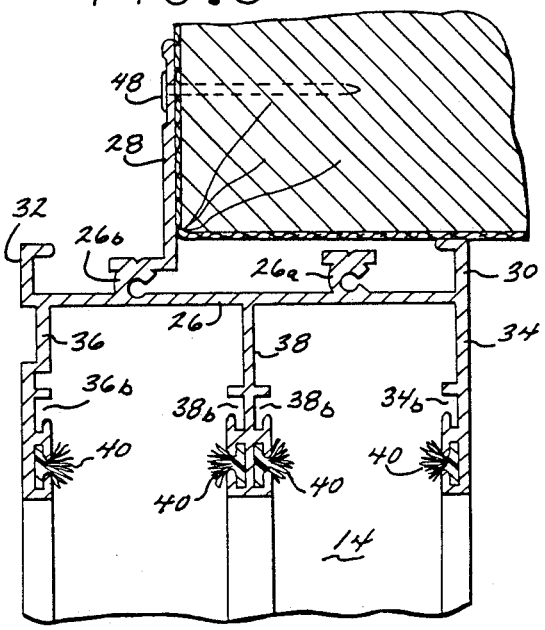
FIG. 6
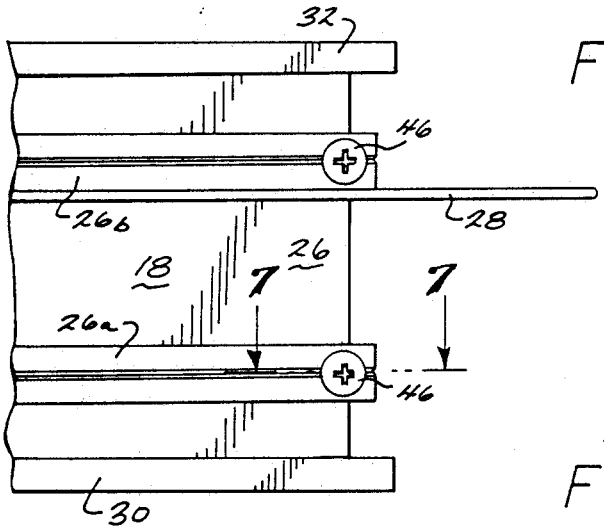
FIG. 7
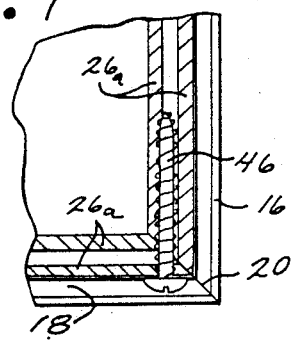
FIG. 8
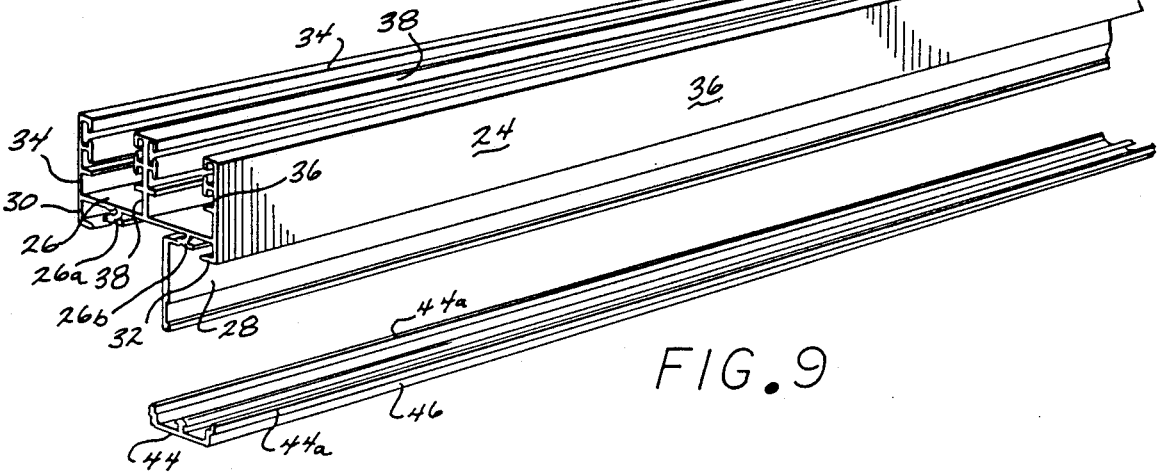
FIG. 9

WINDOW FRAME

This is a continuation-in-part of copending application Ser. No. 07/220,538 filed on July 18, 1988 now abandoned.

The present invention relates generally to window frames for buildings of all types, and more particularly to such frames as are easily formed and readily adaptable to substantially any size or shape opening.

BACKGROUND OF THE INVENTION

As is well realized, there is currently the need for mass producing articles and devices in order to make them more readily available at a minimum price. This pertains to the construction of buildings, particularly residences as well as substantially any other type of article.

Heretofore, although window frames have been made of different types or kinds of extrusions, they have, in accordance with prior designs, required various different extrusions having different cross-sectional configurations. That is, with respect to a rectangular window frame, typically the bottom or lower-most frame member has required a different cross-sectional configuration than the side or vertical frame members. Also, for many designs, the upper-most member has required even a further, different cross-sectional configuration. All of this has contributed to the costliness of providing window frames for buildings of virtually any and all types.

Also, prior window installations have been such that noise has readily penetrated such structures causing discomfort to individuals within the building wherein such prior windows have been located. This has been due to the lack of sealing means about the entire periphery of windows as heretofore constructed.

OBJECTS OF THE INVENTION

In view of the foregoing, it is an object of the present invention to provide a window frame which is capable of receiving a windowpane and wherein all of the frame members are made of the same material, and have the same cross-sectional configuration.

Another object of the present invention is to provide a window frame as characterized above wherein mitered corners can be provided and the finished frame can be quickly and easily secured to the building's structural members provided for that purpose.

A still further object of the present invention is to provide a window frame as characterized above wherein a spacer is provided in the lower-most or bottom frame member to enable the frame to receive a windowpane.

A still further object of the present invention is to provide a window frame as characterized above which can be constructed with the use of a miter saw and fastening screws and an appropriate number of frame members which are identical in cross-sectional configuration.

An even still further object of the present invention is to provide a window frame as characterized above wherein the frame members are extrusions formed of aluminum or an alloy thereof.

Another still further object of the present invention is to provide a window frame as characterized above wherein sound barrier means can be provided about the entire window structure.

An even further object of the present invention is to provide a window frame as characterized above wherein the frame members of similar cross-sectional configuration enable sound-absorbing means to be placed within such frame members to provide the desired sound absorption.

An even still further object of the present invention is to provide a window frame as characterized above which is simple and inexpensive to manufacture and which is rugged and dependable in operation.

BRIEF DESCRIPTION OF THE DRAWINGS

The novel features which I consider characteristic of my invention are set forth with particularity in the appended claims. The invention itself, however, both as to its organization and mode of operation, together with additional objects and advantages thereof, will best be understood from the following description of specific embodiments when read in combination with the accompanying drawings, in which:

FIG. 1 is a fragmentary elevational view of an installed window frame according to the present invention;

FIG. 2 is a fragmentary sectional view taken substantially along line 2—2 of FIG. 1 of the drawings;

FIG. 3 is a fragmentary sectional view taken substantially along line 3—3 of FIG. 2 of the drawings;

FIG. 4 is a fragmentary sectional view taken substantially along line 4—4 of FIG. 1 of the drawings;

FIG. 5 is a fragmentary sectional view taken substantially along line 5—5 of FIG. 1 of the drawings;

FIG. 6 is a fragmentary elevational view taken substantially along line 6—6 of FIG. 1 of the drawings;

FIG. 7 is a fragmentary sectional view taken substantially along line 7—7 of FIG. 6 of the drawings;

FIG. 8 is a fragmentary perspective view of an extrusion for the frame members;

FIG. 9 is a fragmentary perspective view of a spacer for use in the subject window frame.

Like reference characters indicate corresponding parts throughout the several views of the drawings.

DESCRIPTION OF THE PREFERRED EMBODIMENT

Figure 11:
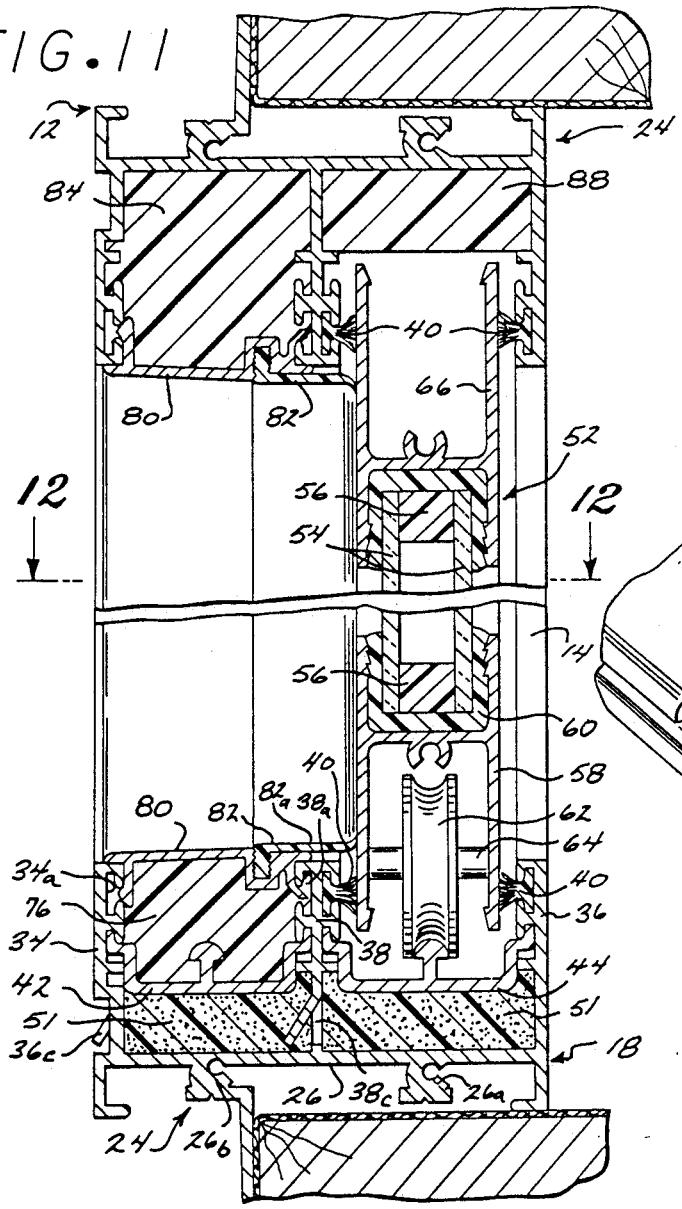
FIG. 11 is a fragmentary vertical sectional view of a second embodiment of the present invention showing top and bottom frame members in cross-section.

Referring to FIG. 1 of the drawings, there is shown therein a window frame 10 according to the present invention. Such frame comprises a top or upper-most frame member 12, side frame members 14 and 16, and a lower-most or bottom frame member 18. Such frame members are joined end-to-end in any appropriate manner, although it has been found most desirable to provide such joinder with miter joints as shown at 20.

In FIG. 1, the frame 10 is shown installed in the appropriate opening of any building such as a residence, there being stucco or plaster material 22 covering the mounting portion of such window frame, as will hereinafter be explained in greater detail.

Each of the frame members 12, 14, 16 and 18 is formed of the same extrusion 24 as shown in FIG. 8 of the drawings. Such extrusion may be of aluminum, an alloy of aluminum or any other appropriate material which is capable of being formed with the desired cross-sectional configuration, as will hereinafter become more apparent.

As will be readily apparent to those persons skilled in the art, the subject invention is not limited to any particular type or style of window frame other than one wherein the frame members are arranged end-to-end to provide a closed pattern, in the central portion of which a windowpane or the like can be provided.

As seen most particularly in FIG. 2 of the drawings, the extrusion 24 is provided with a base member 26 having a pair of semi-circular reinforcing sections **26*a* and 26*b*, from the latter of which a mounting tab or strip 28 is provided. Also extending from base member 26 is a locating member 30 and a finishing section 32**.

Extrusion 24 further comprises oppositely disposed side walls 34 and 36 and an intermediate wall 38. Each of said side walls is formed with oppositely disposed T-shaped elongated slots **34*a* and 36*a*, respectively, and an L-shaped slot or opening 34*b* and 36*b***, respectively.

The intermediate wall 38 is formed with a pair of oppositely-disposed T-shaped slots 38 as well as oppositely-disposed L-shaped slots **38*b*, all of such slots in walls 34, 36 and 38 being generally aligned as shown most particularly in FIGS. 2, 4, 5 and 8** of the drawings.

The T-shaped elongated slots **34*a*, 38*a* and 36*a* are provided with felt sealing strips 40 which are formed with stiff backing which is slidably inserted into such elongated openings as shown in the drawings. The stiff backing of such strips 40** carries felt or other soft material which, as will hereinafter become more apparent, is to prevent the passage of foreign material between the pane and the window frame.

As thus far described, the extrusion 24 is useable as any one of the window frame members 12, 14, 16 and 18. That is, all such frame members are identical in cross-section and emanate from the same extrusion. With the use of a miter saw, the extrusion 24 is then "cut to length" for the various frame members 12, 14, 16 and 18.

Before the frame members are assembled, as shown, the lower-most or bottom frame member 18 is provided with a pair of spacers 42 and 44 from the same extrusion 46 shown in FIG. 9 of the drawings. The extrusion 46, of course, is "cut to length" to provide the spacers 42 and 44, such extrusion 46 being formed with offset side portions, as shown at **42*a* and 44*a* for slideable insertion within the L-shaped slots in the walls 34, 36 and 38 of the extrusion 24. The spacers 42 and 44** enable a pair of windowpanes to be inserted into the frame, as will hereinafter be explained in greater detail.

To enable rain water and the like to drain from the window frame 10, the side wall 36 and the intermediate wall 38 of the bottom frame member 18, may be formed with weep openings as shown respectively at **36*c* and 38*c*. Such openings allow water to drain from the frame due to base member 26 of extrusion 24 being positioned at a slight angle to the horizontal in the extrusion 24 when frame 10** is installed. The weep openings are formed by piercing a small section of the extrusion wall, the remaining material preventing large amounts of air from being forced into the window frame.

The frame 10 is formed, as shown most particularly in FIGS. 6 and 7, by the threaded insertion of fastening screws 46 in the reinforcing sections **26*a* and 26*b*of the extrusion 24. That is, by the use of such fastening devices 46** at the miter joints, the entire window frame is firmly held together for insertion as a unit into the proper opening of a building.

As shown most particularly in FIGS. 2, 4 and 5 of the drawings, the finished window frame is then secured to the structural members of the building by use of a plurality of nails 48 through the appropriate elongated mounting tabs 28. At this time, the alignment member 30 of the extrusion 24 affords means for properly aligning the completed frame within the opening. As shown, sisal kraft paper is provided about the wood structural members of the window opening for providing the proper moisture barrier.

The space outside the mounting tab 28 and extending to the finish member 32 of extrusion 24 can be finished, as desired, with stucco or any other appropriate cementitious material or wood or aluminum siding. In any event, the window frame 10 is thereby enclosed about the structural members of the building so as to provide a finished look for the entire frame and building.

Several windowpanes can be placed in the frame 10, on the spacers 42 and 44. By inserting a windowpane upwardly into the appropriate opening in the extrusion of frame member 12, the windowpane can be thereafter placed on the corresponding spacer. For sliding windowpanes, appropriate roller means may be provided on such windowpanes to cooperate with the upstanding rail which is provided in each spacer.

Although I have shown and described certain specific embodiments of my invention, I am well aware that many modifications thereof are possible. The invention, therefore, is not to be restricted except insofar as is necessitated by the prior art and by the spirit of the appended claims.

Figure 10:
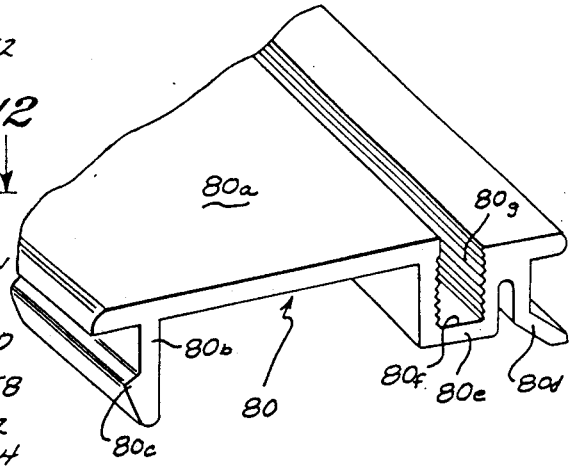
FIG. 10 is a fragmentary perspective view of an insert to be located on the frame members about the periphery of the window frame.
Figure 12:
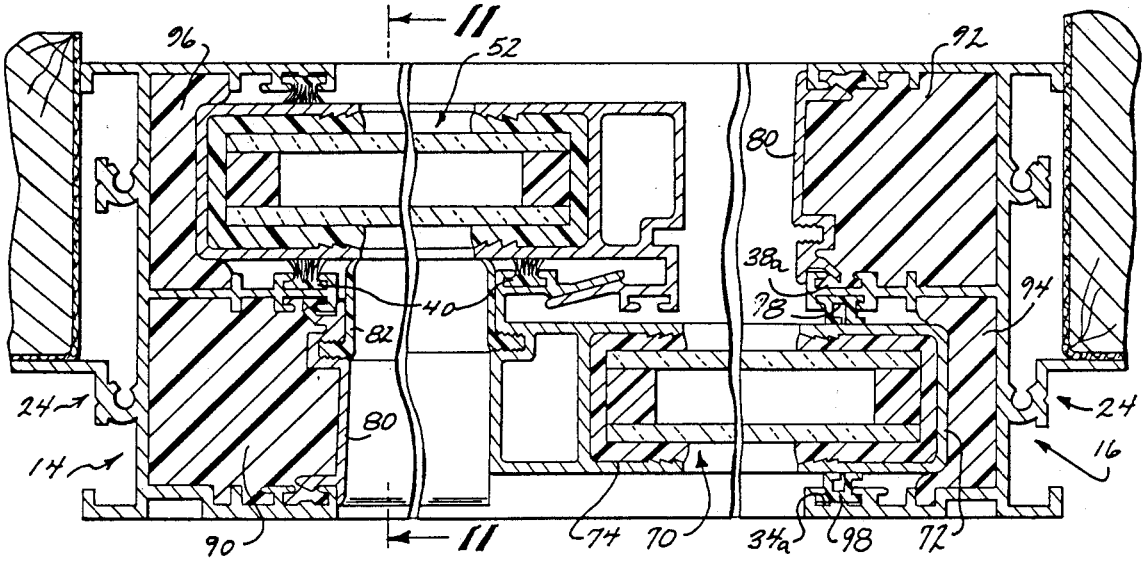
FIG. 12 is a fragmentary horizontal sectional view taken substantially along line 12—12 in FIG. 11.

Referring to FIGS. 10, 11 and 12 of the drawings, there is shown therein a second embodiment of the present invention wherein sound barrier means are employed to prevent the ingress of noise into a building wherein the subject windows are installed.

The extrusions 24, as shown in detail in FIG. 8, are employed as above explained with respect to the first embodiment of the present invention, namely, to provide the top, side and bottom frame members of the resulting window frame, as shown at 12, 14, 16 and 18 in FIGS. 11 and 12 of the drawings.

The cavities found between the bottom frame members 18 and the spacers 42 and 44, namely, between the base member 26 and spacers 42 and 44, and between sidewalls 34 and intermediate wall 38 and between sidewall 36 and intermediate wall 38, respectively, are filled with open-cell polyurethane foam 50 and 51, respectively. Such arrangement permits water or moisture within the frame members to drain through the various weep holes **38*c* and 36*c*** to the outside of the building, as explained above, while nonetheless providing a barrier to the ingress of sound to the interior of the building. The open-cell nature of such polyurethane enables the moisture to readily pass therethrough.

As also shown in FIG. 11 of the drawings, a glazing structure 52 having two panes 54 of glass, spaced apart by spacers 56, are provided to roll on the rail portion of spacer 44. For this purpose, a lower frame 58 is provided wherein the glazing structure 52 is mounted within appropriate sealing means 60. Frame 58 includes a roller 62 rotatably mounted on a shaft 64. A substantially similar upper frame 66 is attached to the upper portion of the glazing structure 52.

The aforementioned sealing brushes 40 mounted in wall members 38 and 36 of extrusion 24 are caused to bear against the frames 58 and 66 to prevent the ingress of dust and moisture.

The area above the spacer 42 is provided with a stationary glazing structure 70 as shown most particularly in FIG. 12 of the drawings. The opposite ends of structure 70 are mounted within generally U-shaped frame members 72 and 74, there being sealing means provided therebetween to prevent the ingress of moisture of other foreign material.

AS will be noted in FIG. 12 of the drawings, the glazing structures 52 and 70 extend slightly more than half the horizontal dimension of the opening provided by the subject window frame shown in FIGS. 11 and 12 of the drawings. As such, the glazing structure 52 can be caused to move to a position substantially parallel to the stationary glazing structure 70 so as to provide an opening from the interior to the exterior of the building.

Provided above the spacer 42 of FIG. 11 is closed-cell polyurethane foam 76 which assists the open cell foam 50 in providing a strong barrier to the ingress of noise or any other type of sound.

An elongated closure member or cap 80 shown in FIG. 10 is provided on the frame member 18 between the sidewall 34 and intermediate wall 38. Such closure member is formed as an extrusion having a relatively flat top wall **80*a*, a depending leg 80*d* having an offset 80*c*, an angular depending member 80** *d* and a depending extension 80 *e*. The latter extension is formed with a groove **80*f* the sidewalls of which are serrated as at 80*g*** to receive a sealing member to be hereinafter described.

Such closure member or cap 80 extends about the inner periphery of the continuous frame members 12, 14, 16, and 18, by virtue of being placed within the T-shaped slots formed in wall members 34 and 38, as shown most particularly in FIGS. 11 and 12 of the drawings. To accomplish this, offset **80*c* of the depending leg 80*b* is inserted within the T-slot 34*a* and the angular member 80*d* is inserted within the T-slot 38*a*. A rubber or plastic member 82 is inserted within the elongated slot 80*f* of extrusion 80 and has a portion 82*a* which overlays a portion of the top 80*a* of extrusion 80 so as to abut the aforedescribed frame member 58 of the moveable glazing structure 52**.

It will be noted that such extrusion 80 is shown in FIG. 11 as engaging both the bottom and top frame members 18 and 12, there being closed-cell polyurethane foam 84 within the cavity formed in upper frame member 12.

Immediately above the moveable glazing structure 52 is noise barrier means in the form of closed-cell polyurethane foam 88.

Referring to FIG. 12 of the drawings, it will be noted that elongated extrusion or closure member 80 is again provided to form cavities within the side frame members 14 and 16. Within such cavities is closed-cell polyurethane foam as shown at 90, 92, 94 and 96. Also, positioned in the T-slots **34*a* and 38*a* of the extrusion which forms the frame member 16 are flexible sealing members 98 which are formed of rubber or plastic material and have L-shaped members which engage the opposite sides of the stationary glazing structure 70** to provide an effective seal.

It is thus seen that the second embodiment of this invention provides a window frame structure wherein all of the frame members are formed of the same extruded material having the same cross-sectional configuration, and wherein barrier means is provided for preventing the ingress of noise or other forms of sound as well as dust, dirt and other foreign materials.

I claim:

1. A window frame comprising, in combination, a plurality of frame members joined end-to-end to form a closed pattern, all of said members having identical cross-sectional configurations, means formed in said frame members for receiving at least a portion of a glazing structure, sealing means comprising polyurethane foam in one or more cavities in each of said frame members joined to the polyurethane sealing means in both adjacent frame members to provide a closed pattern of sealing means for preventing the flow of sound and foreign material from one side of said frame to the other, and a closure member in an elongated slot in each of said frame members, said closure member being formed with an elongated slot, and including a flexible L-shaped sealing member positioned in said slot of said closure member to sealingly engage a glazing structure.

2. A window frame according to claim 1 wherein said L-shaped sealing members are provided in each of said closure members to provide a closed pattern of L-shaped sealing members to effectively seal the periphery of said closed pattern of frame members.

3. A window frame according to claim 2 wherein said elongated slot of each of said closure members is formed with irregular sidewalls for receiving and retaining the respective sealing member.

4. A window frame comprising, in combination, a plurality of frame members joined end-to-end to form a closed pattern, all of said members having identical cross-sectional configurations, means formed in said frame members for receiving at least a portion of a glazing structure, sealing means comprising polyurethane foam in one or more cavities in each of said frame members for preventing the flow of sound and foreign material from one side of said frame to the other, and a closure member in a slot in each of said frame members, said closure member being formed with a slot, and including a flexible L-shaped sealing member positioned in said slot of said closure member to sealingly engage a glazing structure.

5. A window frame according to claim 4 wherein said L-shaped sealing member is formed of plastic or rubber and extends for the length of the respective frame member.

* * * * *